US007325547B2

(12) United States Patent
Draghetti

(10) Patent No.: US 7,325,547 B2
(45) Date of Patent: Feb. 5, 2008

(54) CURLING DEVICE

(75) Inventor: Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 110 days.

(21) Appl. No.: 10/445,829

(22) Filed: May 28, 2003

(65) Prior Publication Data

US 2003/0221695 A1 Dec. 4, 2003

(30) Foreign Application Priority Data

May 29, 2002 (IT) ..... BO2002A0329

(51) Int. Cl.
*A24C 1/08* (2006.01)
*A24C 5/08* (2006.01)
*A24C 5/10* (2006.01)

(52) U.S. Cl. ..... 131/27.1; 131/241; 131/34

(58) Field of Classification Search ..... 162/270, 162/271; 131/58, 60, 88, 94, 61.1, 91, 34
See application file for complete search history.

(56) References Cited

U.S. PATENT DOCUMENTS 3,962,957 A * 6/1976 Hinzmann ..... 493/461
3,996,842 A 12/1976 Ehlich et al.
5,779,616 A * 7/1998 Hintermeier et al. ..... 493/439
2002/0020419 A1* 2/2002 Maiwald et al. ..... 131/69

FOREIGN PATENT DOCUMENTS

EP 0795278 12/1997

OTHER PUBLICATIONS

European Search Report dated Aug. 12, 2003.

* cited by examiner

*Primary Examiner*—Steven P. Griffin
*Assistant Examiner*—Phu H Nguyen
(74) *Attorney, Agent, or Firm*—Timothy J. Klima

(57) ABSTRACT

A curling device for a filter tip attachment comprises at least one blade-like element offered to a continuous strip of paper material at a selected contact zone in such a way as to deform the material as it advances, so that single tipping papers separated from the strip by a cutting unit of the attachment are given a curved profile and as a result more easily wrapped around and affixed to the assembled filters and cigarette sticks when these are joined together; the curling device also comprises a delivery system by which the contact zone is flooded with a cushioning fluid designed to favor a smooth sliding contact between the curling element and the running strip, and at the same time equalize the tensions in the strip preceding and following the contact zone.

16 Claims, 2 Drawing Sheets

CURLING DEVICE

BACKGROUND OF THE INVENTION

The present invention relates to a curling device preferably for cigarette making machines.

The invention finds application to advantage in the art field of cigarette making machinery, and in particular of filter tip attachments, that is to say machine units by which filters and cigarettes are assembled. Reference is made explicitly to this art field in the following specification, albeit with no limitation in general scope implied.

Conventionally, cigarettes and filter tips are assembled by interposing a double length filter plug between two axially aligned cigarette sticks, then joining the filter to the sticks on each side by applying a previously gummed tipping paper, and ultimately cutting the double assembly in half to create two single filter-and-cigarette assemblies.

A filter tip attachment generally comprises a feed station from which a continuous strip of paper material is advanced at a predetermined velocity and under a predetermined degree of tension along a feed path, likewise predetermined; the feed path passes both through a gumming station at which an adhesive substance is applied to one surface of the strip destined to engage the filter-and-cigarette assembly, and through a cutting unit by which the continuous strip is divided into discrete tipping papers ready for application.

Each tipping paper separated by the cutting unit is positioned at an intermediate transfer station and there associated initially with a respective filter-and-cigarette assembly, before being affixed permanently to the selfsame assembly at a further station. The step of affixing the tipping paper permanently to the filter-and-cigarette assembly is accomplished normally by wrapping the paper around the assembly.

This wrapping operation is much facilitated by a curling device installed between the feed station and the cutting unit, which engages the advancing strip and brings about a plastic deformation of the internal fibers. The material thus assumes a given curvature, when relieved of longitudinal tension, with the result that the application of the papers to the respective filter-and-cigarette assemblies is made easier.

The prior art embraces curling devices embodied substantially as a sharp edged element or blade, offered in contact to the continuous strip and generating an action that is designed to weaken the selfsame strip in the transverse direction.

Such curling devices betray certain drawbacks attributable principally to the friction generated at the area of contact between the strip and the aforementioned blade. In particular, it has been observed that the deforming action of the curling device generates high frictional forces tending often to degrade or to break the strip material, especially at the high operating speeds of filter tip attachments now in service.

The object of the present invention is to provide a curling device from which the drawbacks mentioned above are absent.

SUMMARY OF THE INVENTION

The stated object is realized according to the invention in a device for curling a continuous strip of paper material caused to advance along a predetermined feed path toward at least one cutting unit by which the strip is divided into discrete lengths. Such a device typically comprises at least one curling element interacting with an adhesion surface of the continuous strip at a contact zone, in such a way that the paper material is made to flex transversely to a longitudinal dimension of the advancing strip and assume a predetermined curvature.

To advantage, the device disclosed also comprises friction reducing means associated with the curling element and interacting with the continuous strip at the contact zone in such a way as to favor a smooth sliding contact between the element and the strip.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
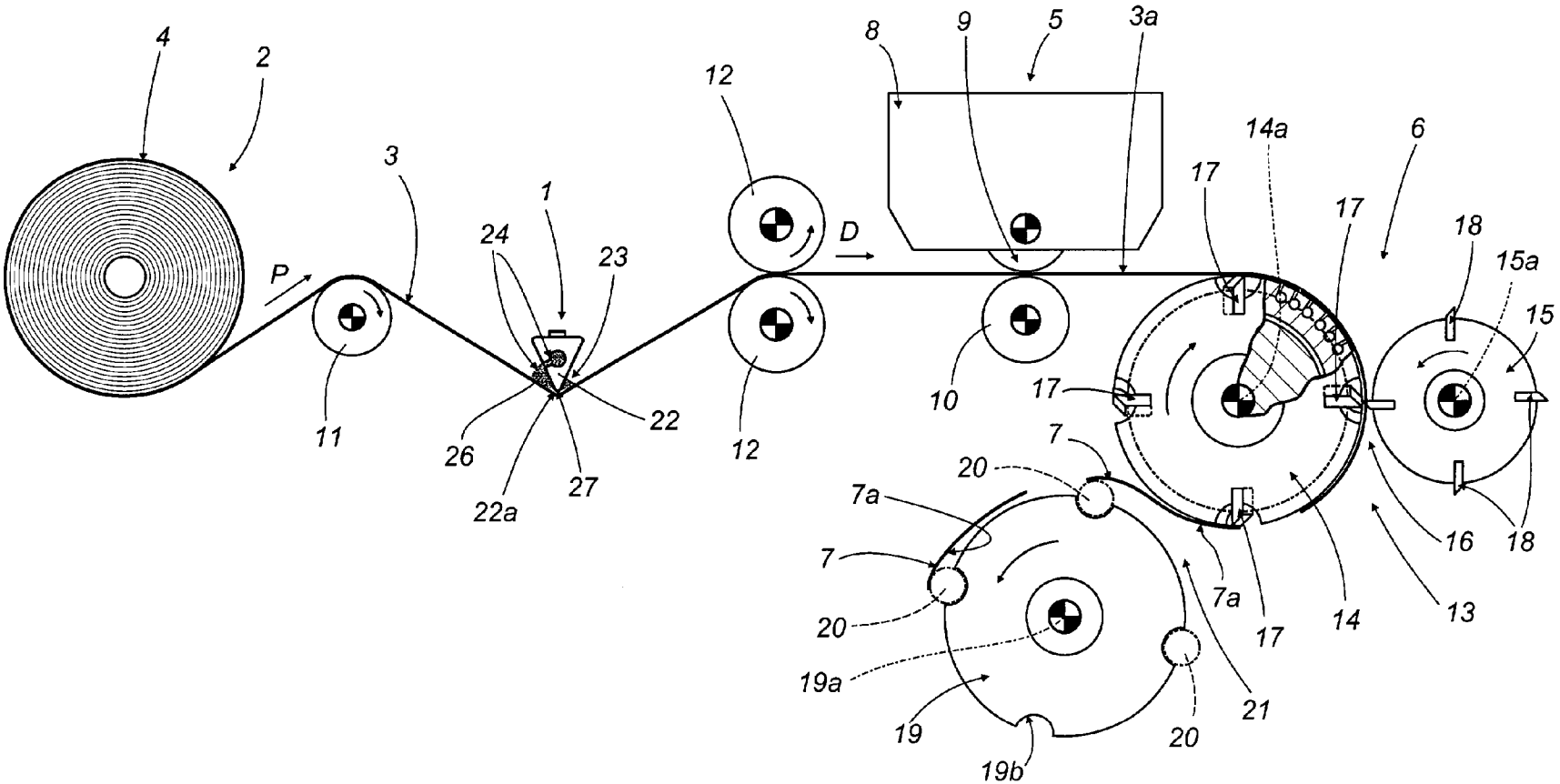
FIG. 1 is a schematic illustration showing a portion of a cigarette maker equipped with a curling device embodied according to the present invention.

With reference to the two accompanying drawings, 1 denotes a curling device, in its entirety, shown associated with a cigarette maker illustrated in part in FIG. 1.

In particular, the device is associated with a filter tip attachment comprising at least one feed station 2 from which a continuous strip 3 of paper or similar material is advanced steadily toward successive stations of the machine.

The continuous strip 3 is decoiled from a roll 4, subject to a predetermined tension and at a given velocity, and advanced along a predetermined feed path P that passes in succession through a gumming station 5 where an adhesive substance is applied to at least one adhesion surface 3*a* of the continuous strip 3, and a cutting unit 6 by which the gummed strip is divided into discrete lengths, or tipping papers 7, each serving to join at least one filter permanently to a respective cigarette stick.

The adhesive substance in question is applied at the gumming station 5 by means of at least one gumming device 8 comprising an applicator roller 9 that acts directly on the adhesion surface 3*a* of the continuous strip 3, and a reaction roller 10 acting on the surface of the strip opposite from the applicator roller 9.

As discernible in FIG. 1, the strip 3 passes over a guide roller 11 positioned upstream of the curling device 1, then through a pair of pinch rolls 12 downstream of the selfsame device 1.

Needless to say, the rollers in question might be located and positioned in any given configuration, as dictated by the production and/or structural requirements of different filter tip attachments.

The cutting unit 6 generates the aforementioned tipping papers 7 utilizing a suction roller 14 and an auxiliary roller 15 of which the respective axes of rotation 14*a* and 15*a* are disposed substantially horizontal and parallel one with another.

The continuous strip 3 is taken up by the suction roller 14, and directed through a cutting zone 16 at which the selfsame roller 14 interacts with the auxiliary roller 15 in such a way as to divide the strip 3 into single tipping papers 7.

The suction roller 14, which presents a diameter greater than that of the auxiliary roller 15 and rotates at a peripheral velocity higher than the linear velocity of the advancing strip 3, carries a plurality of angularly equispaced blades 17 with substantially straight cutting edges set skew to the axis of rotation 14*a*.

The auxiliary roller 15 rotates at a peripheral velocity substantially matching the linear velocity of the advancing strip 3, and carries a plurality of substantially radial blades 18 equispaced around its surface of revolution. These blades 18 present cutting edges set substantially parallel to the axis of rotation 15*a* of the roller 15.

The cutting unit 6 is followed along the feed path P by a conveying roller 19 of conventional embodiment rotatable counterclockwise, as viewed in FIG. 1, about a relative axis denoted 19*a*. The conveying roller 19 affords a plurality of fluted recesses 19*b* extending parallel to the straight line generators of the revolving surface, in which relative filter-and-cigarette assemblies 20, each consisting in two cigarette sticks separated by a double length filter plug, are retained by suction in conventional manner. The filter-and-cigarette assemblies 20 are caused to advance broadside by the conveying roller 19 through a transfer zone 21 where each successive tipping paper 7 generated by the cutting unit 16 is offered to the surface of a respective assembly 20.

The curling device 1 comprises a curling element denoted 22, designed to interact with the adhesion surface 3*a* of the continuous strip 3 in such a way as to flex the selfsame strip at a relative contact zone 23 extending transversely to its longitudinal dimension.

Figure 2:
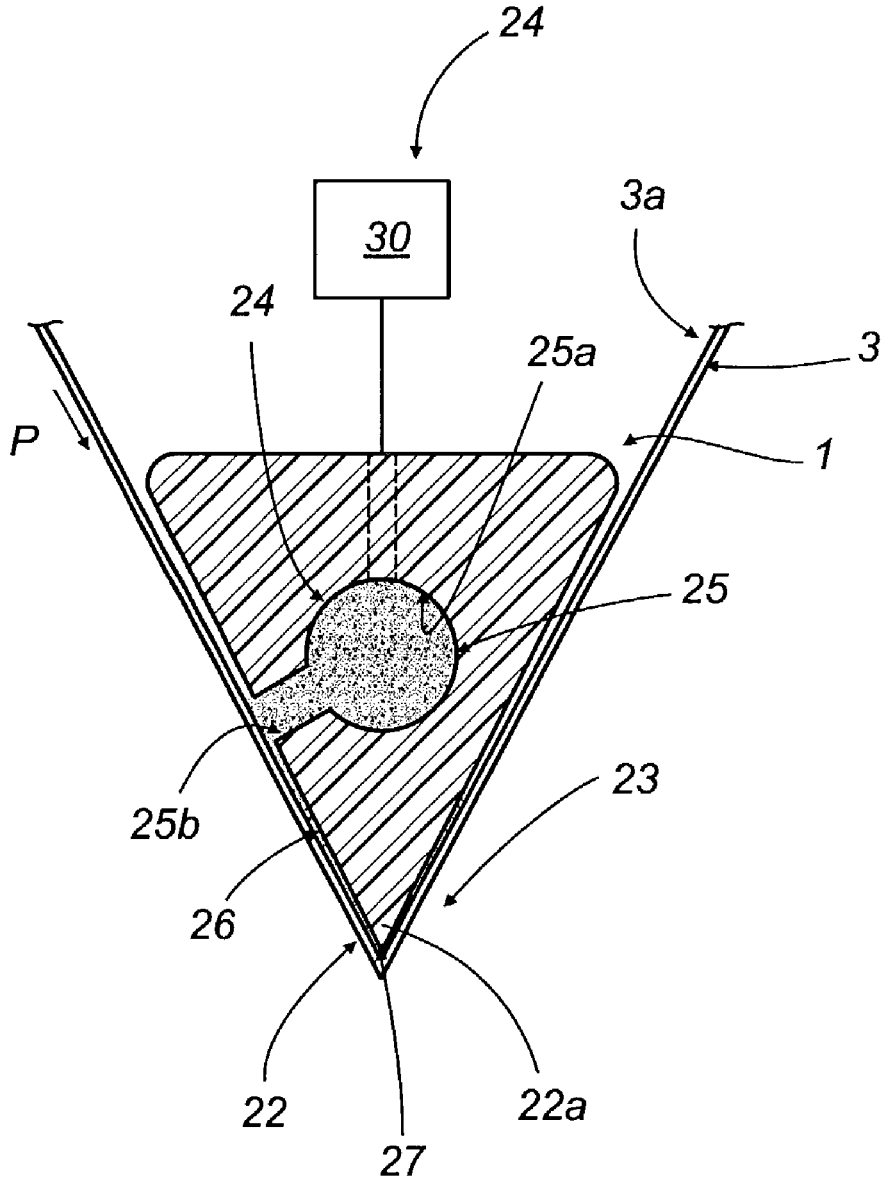
FIG. 2 shows the curling device of FIG. 1, enlarged and in a preferred operating position.

In particular, the guide rollers 11 and pinch rolls 12 aforementioned are positioned along the feed path P, relative to the curling element 22, in such a manner as to establish a leg presenting a Vee profile of which the vertex coincides with the edge 22*a* of the element 22. The angle of the Vee thus created along this leg of the feed path P can hug the element 22 to a greater or lesser degree, according to the positions of this same element and of the rolling elements 11 and 12 one relative to another. FIG. 2 shows a preferred arrangement of the curling element 22 and the rolling elements 11 and 12, with the strip 3 riding in close proximity to the side walls of the curling element 22.

With the strip 3 thus constrained to make a sharp change in direction over the curling element 22 at the contact zone 23, the structure of the material is permanently deformed, assuming a predetermined curvature such that the gummed surface 7*a* of each tipping paper 7 separated by the cutting unit 6 and then offered in contact to a filter-and-cigarette assembly 20 will be concavely profiled. In other words, each tipping paper 7 is curled in such a way that it will cling to and wrap around the external surface of the filter-and-cigarette assembly 20 more easily.

More exactly, the curling element 22 acts on the continuous strip 3 in such a way as to stretch the fibers on the side farthest from the element 22, in relation to the fibers directed toward the selfsame element 22.

As discernible from the accompanying drawings, the curling device 1 presents a cross sectional profile of substantially triangular outline with one substantially sharp edge 22*a*, referable to a longitudinal dimension that extends substantially parallel to the axis of rotation 14*a* of the suction roller 14 for a distance at least equal to the full transverse dimension of the continuous strip 3.

To advantage, the curling device 1 also comprises friction reducing means 24 associated with the curling element 22 and operating at the contact zone 23 in such a manner as to lessen the friction generated between the sharp edge 22*a* of the curling element 22 and the continuous strip 3.

Referring to FIG. 2, such friction reducing means 24 comprise fluid-hydraulic means 25 of which the function is to deliver at least one continuous stream of fluid 26 received from a suitable source, indicated in FIG. 2 by a block denoted 30, at a predetermined and controllable pressure.

The aforementioned friction reducing means 24 are associated with the curling element 22 in such a manner as to deliver the fluid 26 at the contact zone 23. In a preferred embodiment, the means 24 in question will be set up to deliver the fluid 26 at a point upstream of the contact zone 23 occupied by the curling element 22, considered in relation to the feed direction followed by the strip 3, so that the emerging fluid 26 is drawn by the advancing strip 3 between the face of the selfsame strip 3 and the sharp edge 22*a* of the curling element 22. Thus, the fluid 26 trapped between the continuous strip 3 and the curling element 22 functions as a cushion or bearing 27, designed to ease the passage of the strip 3 by attenuating the strength of the frictional forces in play at the contact zone 23.

As discernible from FIGS. 1 and 2, the delivery means 25 include a main delivery duct 25*a* connected internally to the aforementioned source 30 and vented externally to the surrounding environment by way of orifices 25*b* directed toward the advancing strip 3.

More exactly, the delivery means 25 comprise a plurality of such orifices 25*b* arranged parallel one with the next along the longitudinal dimension of the curling element 2 and facing upstream from the selfsame element 22, relative to the direction followed by the strip 3.

The problems associated with the prior are thus overcome by the present invention, and the stated object is duly realized.

In effect, the curling device 1 according to the present invention allows the continuous strip 3 of paper material to be deformed in such a way that it will assume an ideal curvature, able to favor the application of the tipping papers 7 to the filter-and-cigarette assemblies 20 while guaranteeing the physical integrity of the assembly, and therefore the quality of the cigarettes ultimately obtained. In short, by achieving a notable reduction in the friction generated between the curling element 22 and the continuous strip 3, the device 1 allows a smoother passage of the selfsame strip 3 along the feed path P.

Finally, with the adoption of a curling device 1 according to the present invention, the treatment applied to the strip 3 in producing a given depth of curl at a given rate of feed is more delicate, any risk of tearing the material is avoided, and the tensions generated in the continuous strip 3 upstream and the downstream of the contact zone 23 can be equalized.

In particular, the aforementioned fluid 26 could be water vapor or humidified air, suitably treated and maintained at temperatures such as will ensure the desired effects are obtained.

What is claimed is:

1. A device for curling a continuous strip of paper material advancing along a predetermined feed path toward at least one cutting unit by which the selfsame strip is divided into discrete lengths, comprising:

at least one curling element interacting along a width of an adhesion surface of the continuous strip at a contact zone, such that the paper material is caused to flex transversely to a longitudinal dimension of the advancing strip and assume a predetermined curvature;

a fluid delivery mechanism associated with the curling element and interacting with the continuous strip at the contact zone to deliver a cushioning fluid to the contact zone between the curling element and the strip to reduce friction and provide a smooth sliding contact between the curling element and the strip.

2. A device as in claim 1, wherein the fluid delivery mechanism delivers the cushioning fluid at a point upstream of the zone of contact between the curling element and the continuous strip, considered in relation to the feed path followed by the strip, and such that the emerging fluid is drawn by the advancing strip between the selfsame strip and the curling element.

3. A device as in claim 2, wherein the curling element includes at least one sharp edge at the contact zone to flex the advancing strip, the sharp edge being transverse to the longitudinal dimension of the advancing strip.

4. A device as in claim 1, wherein the fluid delivery mechanism comprises a main delivery duct vented externally by way of orifices directed toward the continuous strip and connected internally to a source of the fluid.

5. A device as in claim 4, wherein the fluid delivery mechanism comprises a plurality of orifices facing upstream from the curling element in relation to the feed direction followed by the continuous strip.

6. A device as in claim 5, wherein the curling element includes at least one sharp edge at the contact zone to flex the advancing strip, the sharp edge being transverse to the longitudinal dimension of the advancing strip.

7. A device as in claim 4, wherein the curling element includes at least one sharp edge at the contact zone to flex the advancing strip, the sharp edge being transverse to the longitudinal dimension of the advancing strip.

8. A device as in claim 1, wherein the curling element presents a triangular cross sectional profile.

9. A device as in claim 1, wherein the curling element engages the continuous strip by way of at least one sharp edge.

10. A device as in claim 1, wherein the curling element includes at least one sharp edge at the contact zone to flex the advancing strip, the sharp edge being transverse to the longitudinal dimension of the advancing strip.

11. A cigarette maker comprising:

at least one feed station from which a continuous strip of paper material is directed along a predetermined feed path;

at least one cutting unit by which the continuous strip is taken up and divided into discrete lengths serving to join filters to cigarettes;

at least one device for curling the continuous strip of paper, disposed between the at least one feed station and the at least one cutting unit, comprising:

at least one curling element interacting along a width of an adhesion surface of the continuous strip at a contact zone, such that the paper material is caused to flex transversely to a longitudinal dimension of the advancing strip and assume a predetermined curvature;

a fluid delivery mechanism associated with the curling element and interacting with the continuous strip at the contact zone to deliver a cushioning fluid to the contact zone between the curling element and the strip to reduce friction and provide a smooth sliding contact between the curling element and the strip.

12. A cigarette maker as in claim 11, wherein the fluid delivery mechanism delivers the cushioning fluid at a point upstream of the zone of contact between the curling element and the continuous strip, considered in relation to the feed path followed by the strip, and such that the emerging fluid is drawn by the advancing strip between the selfsame strip and the curling element.

13. A cigarette maker as in claim 12, wherein the fluid delivery mechanism comprises a main delivery duct vented externally by way of orifices directed toward the continuous strip and connected internally to a source of the fluid.

14. A cigarette maker as in claim 13, wherein the fluid delivery mechanism comprises a plurality of orifices facing upstream from the curling element in relation to the feed direction followed by the continuous strip.

15. A cigarette maker as in claim 14, wherein the curling element includes at least one sharp edge at the contact zone to flex the advancing strip, the sharp edge being transverse to the longitudinal dimension of the advancing strip.

16. A device for curling a continuous strip of paper material advancing along a predetermined feed path toward at least one cutting unit by which the selfsame strip is divided into discrete lengths, comprising;

at least one curling element interacting along a width of an adhesion surface of the continuous strip at a contact zone, such that the paper material is caused to flex transversely to a longitudinal dimension of the advancing strip and assume a predetermined curvature; and friction reducing means associated with the curling element and interacting with the continuous strip at the contact zone to provide a smooth sliding contact between the element and the strip;

wherein said friction reducing means comprise a fluid delivery mechanism, associated with the curling element, by which at least one cushioning fluid is delivered at a point upstream of the zone of contact between the curling element and the continuous strip, considered in relation to the feed path followed by the strip, and such that the emerging fluid is drawn by the advancing strip between the strip and the curling element.

* * * * *